US008087957B2

(12) United States Patent
Komatsu

(10) Patent No.: US 8,087,957 B2
(45) Date of Patent: Jan. 3, 2012

(54) TERMINAL MEMBER

(75) Inventor: Seiji Komatsu, Aichi (JP)

(73) Assignee: TYCO Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 12/854,447

(22) Filed: Aug. 11, 2010

(65) Prior Publication Data

US 2011/0053432 A1 Mar. 3, 2011

(30) Foreign Application Priority Data

Aug. 28, 2009 (JP) ..... 2009-198120

(51) Int. Cl.
*H01R 13/40* (2006.01)

(52) U.S. Cl. ..... 439/733.1

(58) Field of Classification Search ..... 439/733.1, 439/738, 695, 737, 638, 862, 345
See application file for complete search history.

(56) References Cited

U.S. PATENT DOCUMENTS 5,605,478 A * 2/1997 Woodard ..... 439/695
5,836,773 A * 11/1998 McHugh et al. ..... 439/74
6,273,731 B1 * 8/2001 Bishop et al. ..... 439/66
6,752,652 B1 * 6/2004 Robinson ..... 439/517
6,926,539 B2 * 8/2005 Zaderej et al. ..... 439/74
7,014,477 B2 * 3/2006 Tsai ..... 439/71
2010/0178787 A1 * 7/2010 Lux ..... 439/271

FOREIGN PATENT DOCUMENTS

JP 2006-081373 3/2006

* cited by examiner

*Primary Examiner* — Jean F Duverne
(74) *Attorney, Agent, or Firm* — Barley Snyder

(57) ABSTRACT

A terminal member capable of connecting a motor and a motor control circuit unit to each other reliably and efficiently. The terminal member includes first and second terminals, a pressing member, an urging member and a holder. The first terminal and second terminals are positioned facing each other, while the pressing member is positioned above the second terminal. The pressing member presses and electrically connects the first terminal and the second terminal. The urging member is positioned above and abutting the pressing member such that the pressing member urges in a direction toward the first terminal. The holder includes a recess that secures the pressing member and the urging member.

18 Claims, 7 Drawing Sheets

TERMINAL MEMBER

CROSS-REFERENCE TO RELATED APPLICATIONS

This application claims priority under 35 U.S.C. §119 to Japanese Patent Application No. 2009-198120, filed Aug. 28, 2009.

FIELD OF THE INVENTION

The invention relates to a terminal member used to connect a motor and a motor driving circuit to each other.

BACKGROUND

Conventionally, each phase of a motor and a control circuit unit for inverter control have been provided separately, each of which are electrically connected using an intermediate harness. However, in recent years, in order to reduce manufacturing time and labor for connecting the intermediate harness, as well as to minimize space, the integration of the motor and the control circuit unit for inverter control has been long studied.

Considering that a high electrical current flows in such a multi-phased motors, Japanese Patent Laid-Open No. 2006-81373 discloses such a design having a bus bar with a large cross-sectional area connecting a terminal connected to each phase of the motor and a terminal on the control circuit unit. In order to achieve high reliability, a bolt has generally been used to connect the terminals to each other either directly or through the intermediate harness.

However, the number of bolts generally correspond to the number of motor phases, i.e. three phases. Therefore, to connect the terminals to each other, a large number of bolts must be tightened, which increases time and labor.

SUMMARY

It is an object of the invention, among others, to provide a terminal member capable of connecting a motor and a motor control circuit unit to each other reliably and efficiently.

The terminal member includes first and second terminals, a pressing member, an urging member and a holder. The first terminal and second terminals are positioned facing each other, while the pressing member is positioned above the second terminal. The pressing member presses and electrically connects the first terminal and the second terminal. The urging member is positioned above and abutting the pressing member such that the pressing member urges in a direction toward the first terminal. The holder includes a recess that secures the pressing member and the urging member.

BRIEF DESCRIPTION OF THE DRAWINGS

The invention will be explained in greater detail below with reference to Figures and exemplary embodiments, without the general concept of the invention being limited.

DETAILED DESCRIPTION OF THE EMBODIMENT(S)

An embodiment of the invention will now be described in detail with reference to the accompanying drawings.

Figure 1:
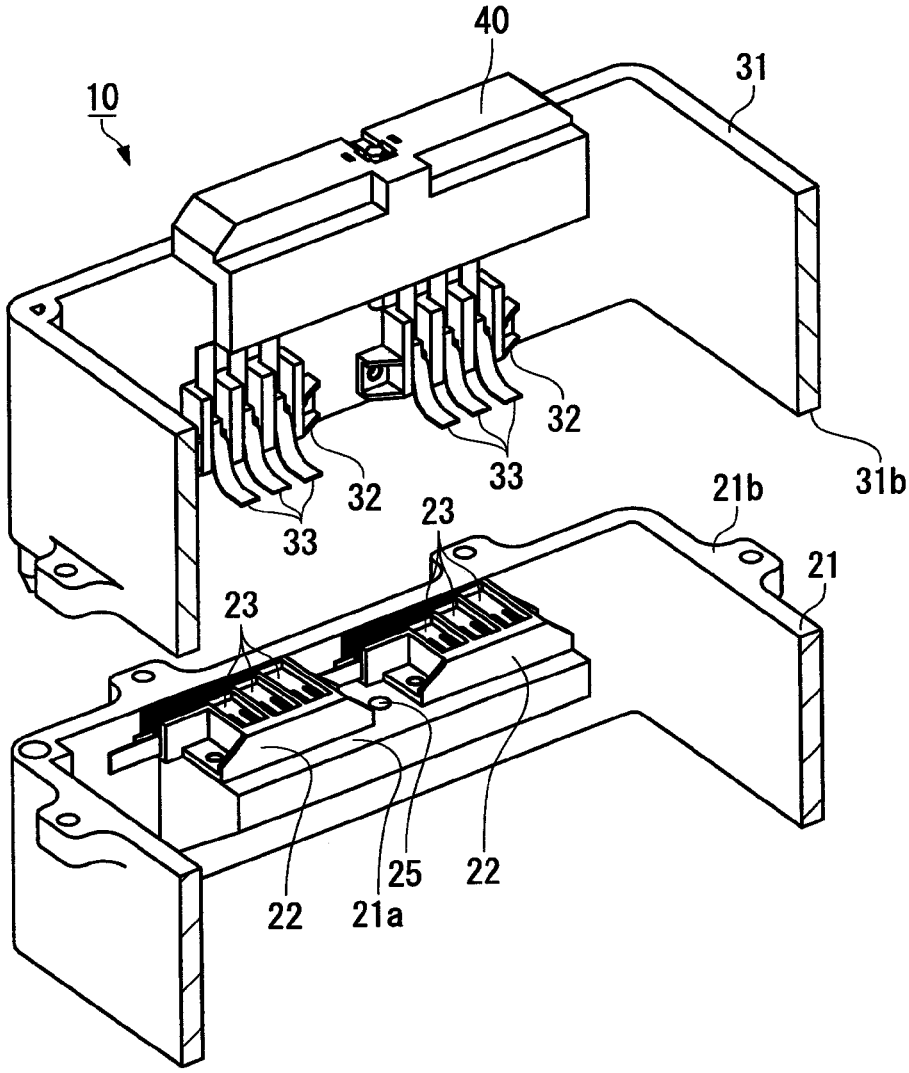
FIG. 1 is a perspective view of a terminal member according to the invention.

FIG. 1 is an explanatory view for explaining the configuration of a terminal member 10 according to the invention, for connecting a motor and an inverter control circuit to each other.

Figure 2A:
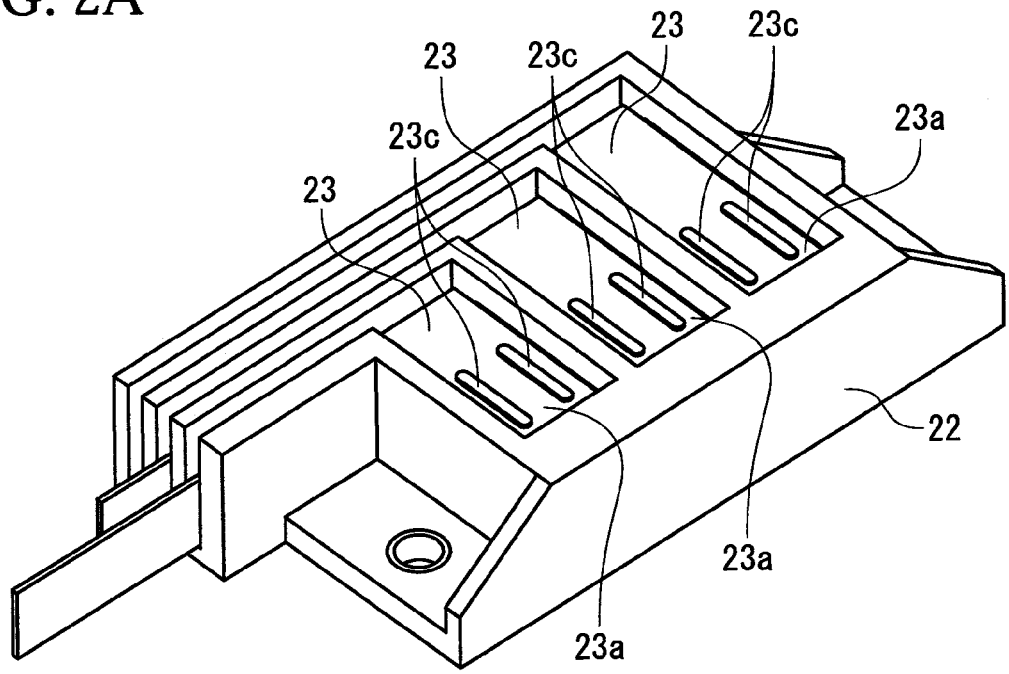
FIG. 2A is a perspective view of a terminal holding member of the terminal member on the motor side.

As shown in FIG. 1, on a motor side, a motor-side terminal block 21 is integrally provided in a housing of a motor. The motor-side terminal block 21 includes a block 21*a*, and a terminal holding member 22 is provided on the block 21*a*. As shown in FIG. 2A, the terminal holding member 22 includes a number of terminals 23 for supplying a current to each phase of the motor.

Each of the terminals 23 is a so-called bus bar that is formed by fabricating a strip-shaped rigid metallic plate having a fixed thickness into a predetermined shape. The terminal 23 is configured so that one end side thereof (not shown) penetrates the terminal holding member 22 to be connected to each phase of the motor, and a distal end 23*a* thereof is held so as to be located in a plane parallel with the surface of the block 21*a* in the terminal holding member 22. Also, the distal end 23*a* of the terminal 23 includes, for example, a ridge 23*c* that is continuous in the extending direction of the terminal 23. The continuity direction, shape, and the like of the ridge 23*c* are not subject to any special restriction.

Figure 2B:
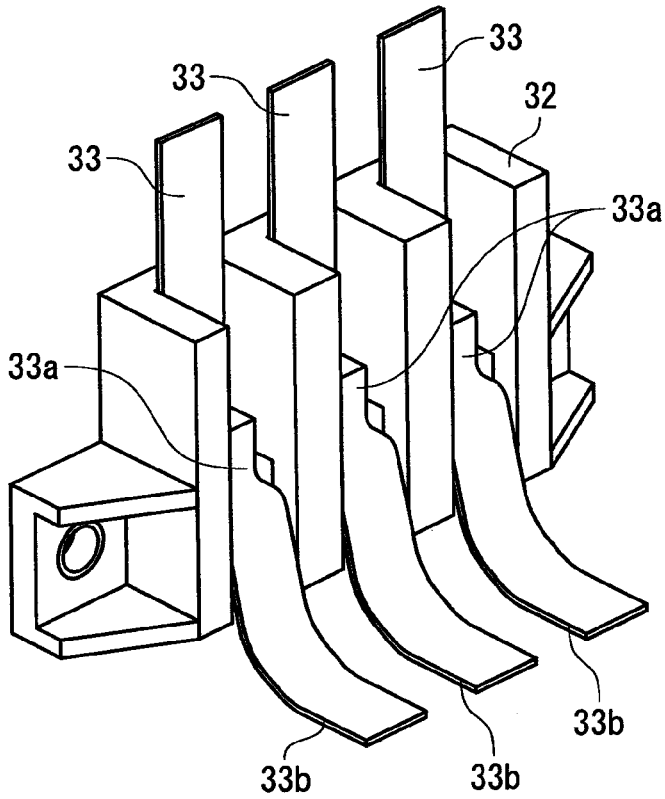
FIG. 2B is a perspective view of a terminal holding member of the terminal member on the inverter side.

As shown in FIG. 1, on the inverter control circuit side, an inverter-side terminal block 31 is integrally provided in a housing of an inverter control circuit. On the inverter-side terminal block 31, a terminal holding member 32 is provided. As shown in FIG. 2B, the terminal holding member 32 includes a plurality of terminals 33 for supplying a current from the inverter control circuit to each phase of the motor so as for the terminals 33 to correspond to the terminals 23 of the motor-side terminal block 21.

Each of the terminals 33 is a so-called bus bar that is formed by fabricating a strip-shaped rigid metallic plate having a fixed thickness into a predetermined shape. The terminal 33 is configured so that one end side thereof (not shown) penetrates the terminal holding member 32 to be connected to each phase of the inverter control circuit, and the other end side thereof is held by the terminal holding member 32.

Figure 3:
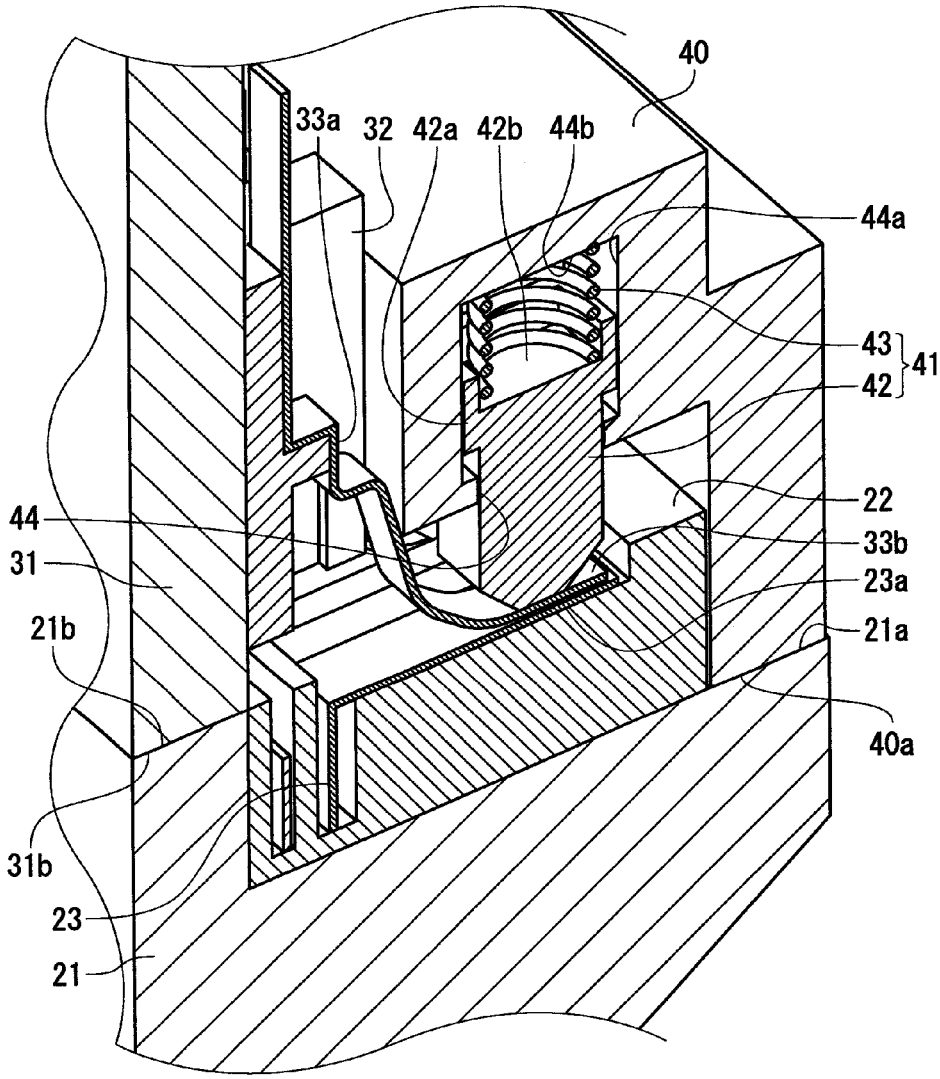
FIG. 3 is a sectional perspective view of a terminal on the motor side and a terminal on the inverter side that are connected to each other by a pressing member according to the invention.

As shown in FIGS. 2B and 3, on the other end side of each of the terminals 33, a grip 33*a* is held by the terminal holding member 32 whereas a distal end 33*b* is curvedly extended so as to face the distal end 23*a* of the terminal 23 held by the motor-side terminal block 21. In this configuration, when a top surface 21*b* of the motor-side terminal block 21 and a bottom surface 31*b* of the inverter-side terminal block 31 are pressed against each other, the distal end 33*b* of the terminal 33 faces the distal end 23*a* of the terminal 23 of the motor-side terminal block 21, and is elastically deformable in the direction such as to approach and separate from the distal end 23*a* of the terminal 23.

As shown in FIG. 1, the inverter-side terminal block 31 includes a pin holder 40 in order to electrically connect the motor-side terminals 23 and the inverter-side terminals 33.

Figure 4A:
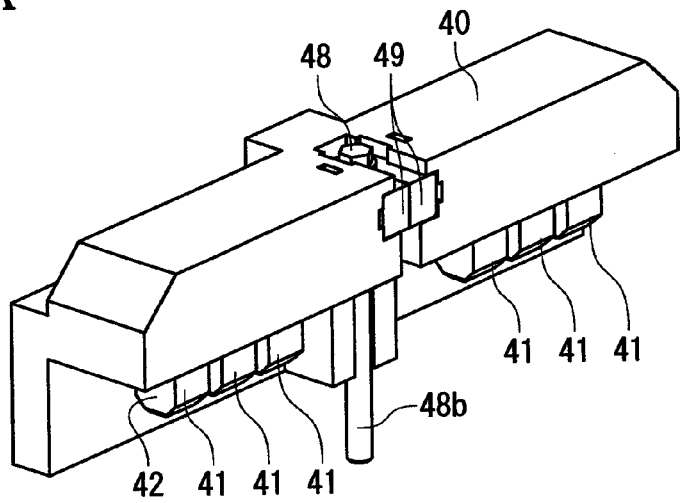
FIG. 4A is a perspective view of a pin holder.

As shown in FIG. 4, the pin holder 40 includes a plurality of pressing mechanisms 41 for electrically connecting the terminal 33 and the terminal 23 by pressing the terminal 33. The number of the pressing mechanisms 41 corresponds to the number of sets of the terminals 23 and 33.

Each of the pressing mechanisms 41 includes a pin 42, which is a pressing member, and an urging member 43.

As shown in FIG. 3, the pin 42 is of, for example, a prismatic shape, and the upper end part of the pin 42 includes a flange 42*a* projecting to the outer periphery side. The pin 42 is received in a recess 44 formed in the pin holder 40 so as to be movable along the axis direction of the pin 42 (the direction such that the distal end 23*a* of the terminal 23 and the distal end 33*b* of the terminal 33 are brought close to and separated from each other). The recess 44 includes an expanded section 44*a*, and the flange 42*a* of the pin 42 is held in the expanded section 44*a* so that the movement stroke in the axis direction of the pin 42 is restricted and the pin 42 is prevented from fully coming out of the recess 44.

The urging member 43 in the embodiment shown is a coil spring. However it is also possible that the urging member 43 could be a diaphragm spring, a plate spring, or other elastic device known to the art. The urging member 43 is compressed between a base end surface 42*b* of the pin 42 and a bottom surface 44*b* of the recess 44, which urges the pin 42 in a direction such that the pin 42 projects from the recess 44.

Figure 4B:
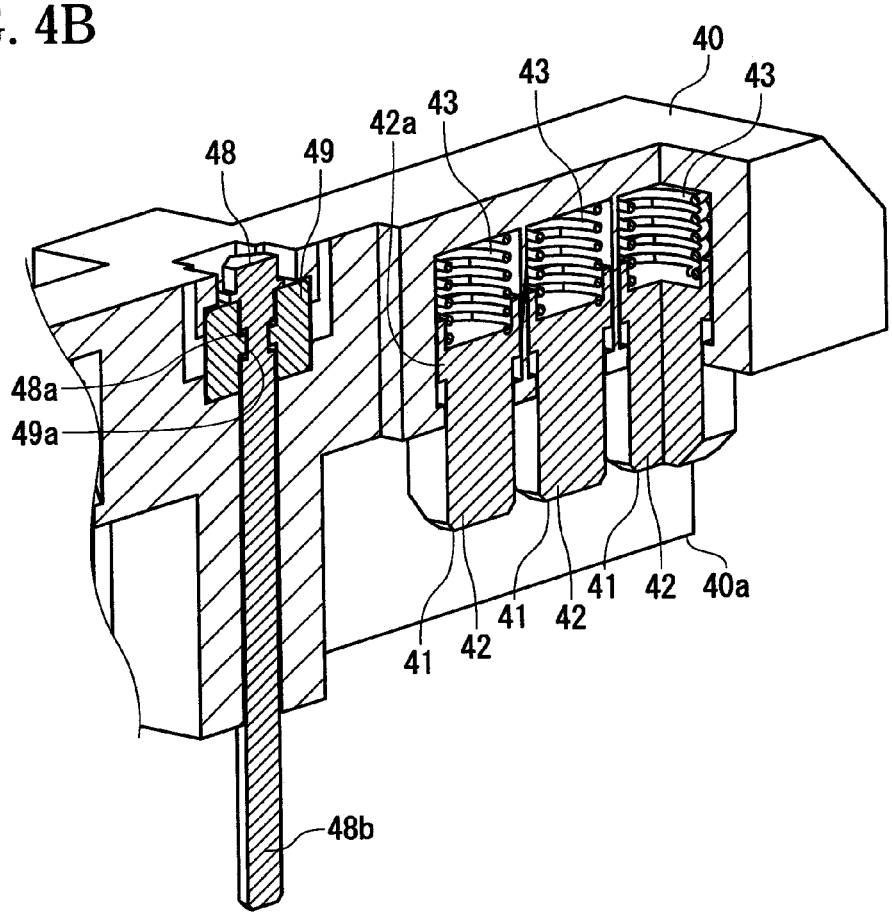
FIG. 4B is a sectional perspective view showing pressing mechanisms and a connecting bolt provided in the pin holder.

As shown in FIGS. 4 and 4B, the pin holder 40 includes a connecting bolt 48 in the central part thereof. The connecting bolt 48 is held in the pin holder 40 so as to be turnable around the axis thereof via a holding member 49. On the outer peripheral surface of the connecting bolt 48 and the inner peripheral surface of the holding member 49, step sections 48*a* and 49*a* engaging with each other, respectively, are formed so as to be continuous in the circumferential direction. Thereby, the connecting bolt 48 is restrained from moving in the axis direction with respect to the inverter-side terminal block 31.

A distal end 48*b* of the connecting bolt 48 has threads, which can be screwed into a threaded hole 25 formed in the block 21*a* of the motor-side terminal block 21. When the distal end 48*b* of the connecting bolt 48 is screwed into the threaded hole 25 while the motor-side terminal block 21 and the inverter-side terminal block 31 are pressed against each other, the motor-side terminal block 21 and the pin holder 40 are urged toward each other by the tightening force of the connecting bolt 48. Finally, as shown in FIG. 3, a bottom surface 40*a* of the pin holder 40 engages the block 21*a* of the motor-side terminal block 21.

Also, when the connecting bolt 48 is loosened, the pin holder 40 moves away from the terminal holding member 22 of the motor-side terminal block 21.

In order to electrically connect the motor and the inverter to each other by using the terminal member 10 having the motor-side terminal block 21, the inverter-side terminal block 31, and the pin holder 40 configured as described above, the procedure described below is carried out.

Figure 5A:
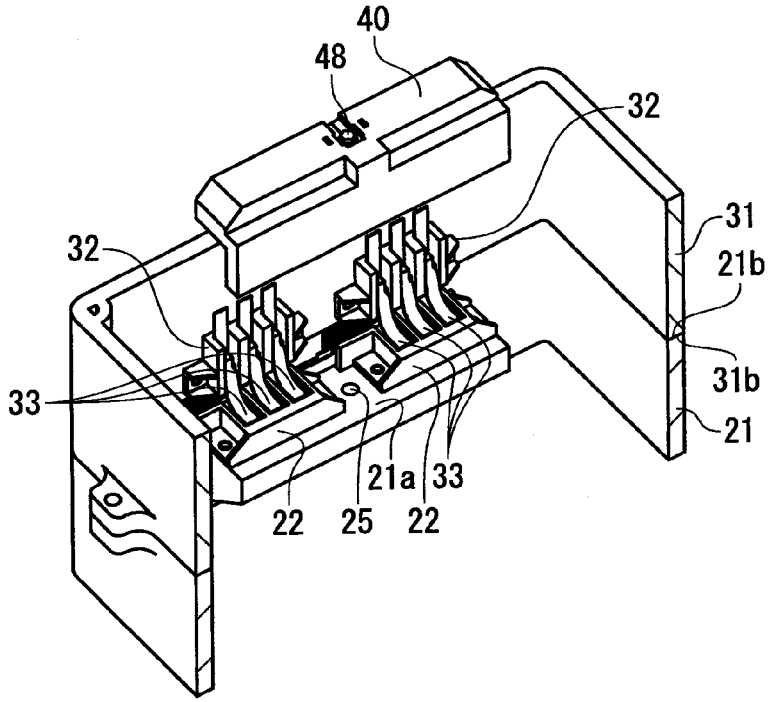
FIG. 5A is a perspective view of a motor-side terminal block and an inverter-side terminal block pressed against each other.
Figure 6:
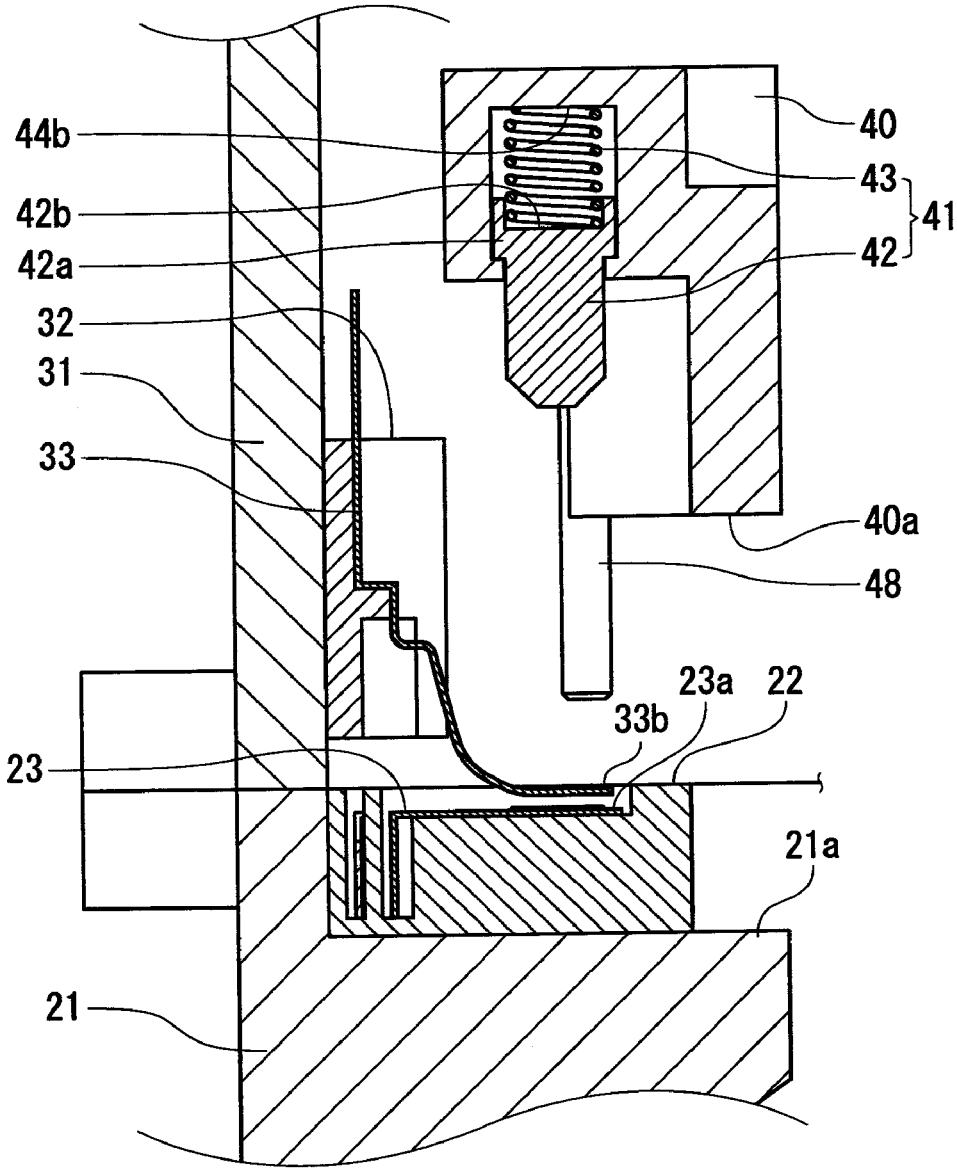
FIG. 6 is a sectional view of the motor-side terminal and the inverter-side terminal facing each other.

First, as shown in FIG. 5A, the top surface 21*b* of the motor-side terminal block 21 and the bottom surface 31*b* of the inverter-side terminal block 31 are pressed against each other. Then, as shown in FIG. 6, the distal end 23*a* of the terminal 23 held by the terminal holding member 22 of the motor-side terminal block 21 and the distal end 33*b* of the terminal 33 held by the terminal holding member 32 of the inverter-side terminal block 31 face each other.

When the connecting bolt 48 is screwed into the threaded hole 25 in this state, the motor-side terminal block 21 and the pin holder 40 are urged toward each other by the tightening force of the connecting bolt 48. At this time, in each of the pressing mechanisms 41 provided in the pin holder 40, the pin 42 is urged by the urging member 43, and shows a maximum extension from the pin holder 40.

Figure 5B:
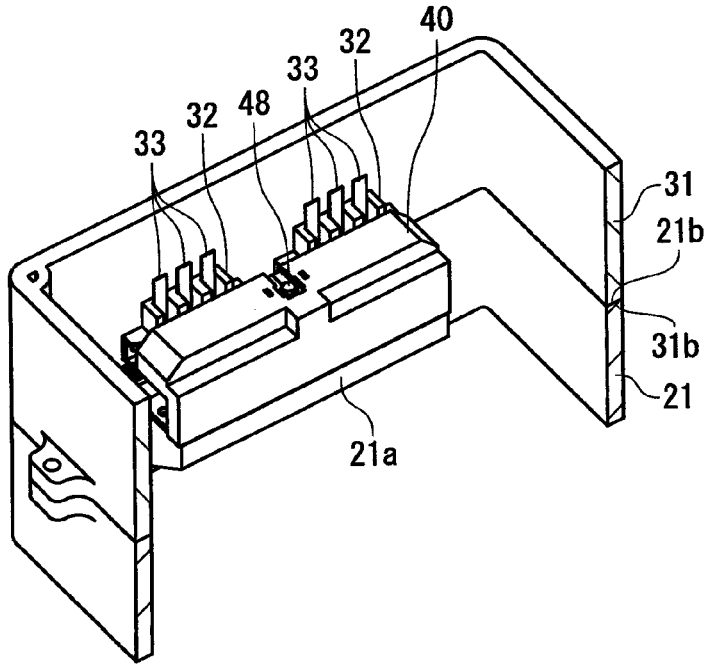
FIG. 5B is a perspective view of a motor-side terminal and an inverter-side terminal connected to each other by a pin holder.
Figure 7:
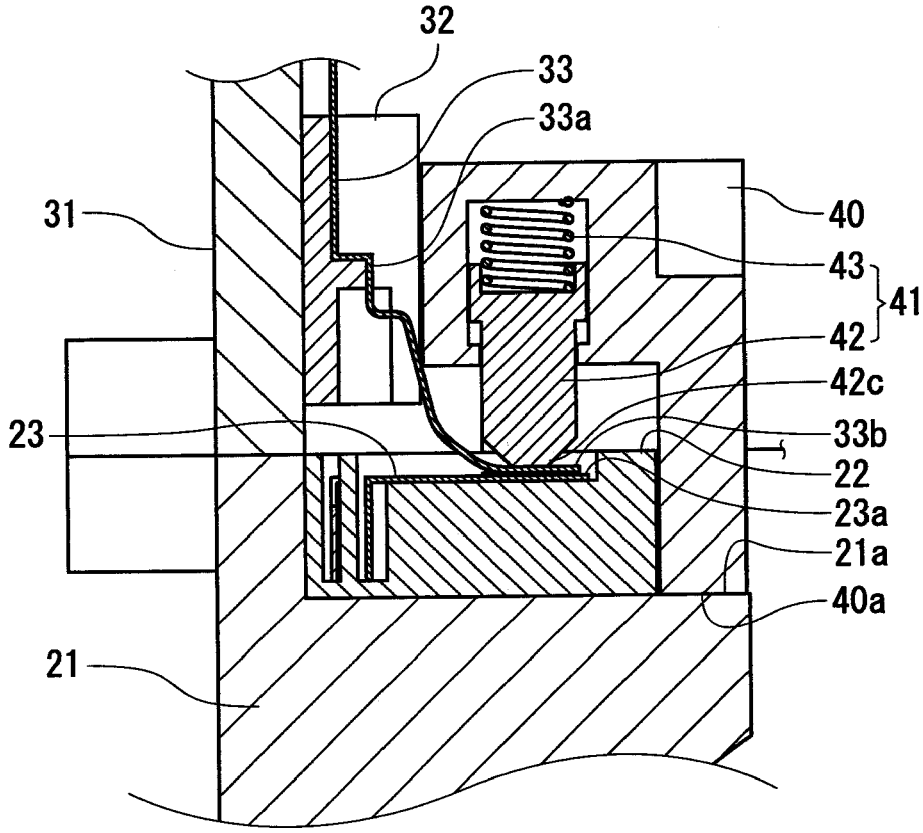
FIG. 7 is a sectional view of the motor-side terminal and the inverter-side terminal connected to each other by a pin.

As shown in FIG. 5B, the connecting bolt 48 is tightened further, and the pin holder 40 moves toward the motor-side terminal block 21. If the connecting bolt 48 is tightened until the bottom surface 40*a* of the pin holder 40 engages the block 21*a* of the motor-side terminal block 21, as shown in FIG. 7, a distal end 42*c* of the pin 42 contacts a distal end 33*b* of the terminal 33. The pin 42 presses the distal end 33*b* of the terminal 33 in the direction that the distal end 33*b* moves towards a distal end 23*a* of the terminal 23 by the urging force of the urging member 43. Then, the ridges 23*c* of the terminal 23 come into close contact with the distal end 33*b* of the terminal 33, whereby the terminals 23 and 33 are electrically connected to each other directly. Accordingly, the terminals 23 and 33 are held between the pin holder 40 and the motor-side terminal block 21.

In the above-described process in which the distal end 33*b* of the terminal 33 is pressed by the pin 42 to connect the distal end 23*a* of the terminal 23 and the distal end 33*b* of the terminal 33, the contact position between the distal end 23*a* of the terminal 23 and the distal end 33*b* of the terminal 33 may change. At this time, the pin 42, the distal end 23*a* of the terminal 23 of the motor-side terminal block 21, and the distal end 33*b* of the terminal 33 of the inverter-side terminal block 31 move so as to slide from each other so that the change in contact position can be accommodated.

Also, when the connecting bolt 48 is loosened, the pin holder 40 moves away from the motor-side terminal block 21. Then, the pin 42 separates from the terminal 33, and finally, as shown in FIG. 6, the terminals 23 and 33 move apart, facing each other, and the connection is released.

As described above, the plurality of pressing mechanisms 41 advantageously causes the plurality of sets of the terminals 23 and 33 to be electrically connected by the pressing mechanisms 41 by simply pushing the pin holder 40 in. Accordingly, the terminals 23 and 33 are connected to each other by a single motion.

Moreover, since the pin holder 40 is mounted easily by using the connecting bolt 48, the terminals 23 and 33 are connected to each other easily and reliably also in this respect.

In the above-described embodiment, the configurations of the motor-side terminal block 21 and the inverter-side terminal block 31 have been described. However, the specific shapes and configurations thereof may be any other ones as far as falling within the spirit and scope of the invention.

Also, the motor to which the invention can be applied is not limited to the motor in accordance with this embodiment, but may be a motor for any other application.

Besides, the configurations described in the above-described embodiment can be selected or changed to other configurations as appropriate without departing from the spirit and scope of the invention.

What is claimed is:

1. A terminal member comprising:

a first terminal block holding a first terminal and being movable toward a second terminal block holding a second terminal, the first terminal and the second terminal positioned facing each other;

a pressing member positioned above the second terminal;

an urging member positioned above and abutting the pressing member such that the pressing member is biased toward the first terminal;

a holder having a recess within which the pressing member and the urging member are held; and a connecting bolt positioned through and secured in the first terminal block, the connecting bolt received in a connecting bolt passageway of the second terminal block and urging the first terminal block and the second terminal block together when the connecting bolt is rotated.

2. The terminal member according to claim 1, wherein the second terminal elastically deforms in a direction toward the first terminal when the first terminal block presses against the second terminal block.

3. The terminal member according to claim 1, wherein the second terminal block includes a block and a terminal holding member positioned on the block.

4. The terminal member according to claim 3, wherein the second terminal is configured so that one end side thereof penetrates the terminal holding member and a distal end is positioned plane parallel with a surface of the block.

5. The terminal member according to claim 1, wherein the first and second terminals are bus bars formed from a strip-shaped rigid metallic plate having a fixed thickness into a predetermined shape.

6. The terminal member according to claim 1, wherein the first terminal block includes a terminal holding member that secures the first terminal.

7. The terminal member according to claim 6, wherein the first terminal is configured to have one end side that penetrates the terminal holding member of the first terminal block, while an opposite end side is held by the terminal holding member.

8. The terminal member according to claim 7, wherein the first terminal includes a grip secured by the first terminal holding member and a distal end that curvedly extends to face a distal end of the second terminal.

9. The terminal member according to claim 1, wherein the pressing member is a prismatic shape with an upper end part having a flange that projects to an outer periphery side.

10. The terminal member according to claim 9, wherein the recess receives the pressing member so as to be movable along an axis direction such that the pressing member urges the first terminal and the second terminal close to each other.

11. The terminal member according to claim 10, wherein the recess includes an expanded section that secures the flange of the pressing member in order to limit stroke movement in the axis direction.

12. The terminal member according to claim 11, wherein the urging member is compressed between the pressing member and the recess, the urging member urges the pressing member in a direction such that the pressing member extends from the recess.

13. A pin holder comprising:

a recess;

a pressing member positioned in the recess;

an urging member positioned between an end surface of the pressing member and a bottom surface of the recess, the urging member being biased against the pressing member in a direction such that the pressing member projects from the recess; and a connecting bolt in the pin holder being turnable around the axis thereof through a holding member.

14. The pin holder according to claim 13, wherein the pressing member has a prismatic shape with an upper end part having a flange that projects to an outer periphery side.

15. The pin holder according to claim 14, wherein the recess includes an expanded section.

16. The pin holder according to claim 15, wherein the flange of the pressing member is secured in the expanded section in order to limit stroke movement of the pressing member in the axis direction.

17. The pin holder according to claim 13, wherein the urging member is a coil spring.

18. The pin holder according to claim 17, wherein the urging member is compressed between the pressing member and the recess.

* * * * *